US005337911A

United States Patent [19]

Holub

[11] Patent Number: 5,337,911

[45] Date of Patent: Aug. 16, 1994

[54] CONTAINER WITH MAIN LID AND AUXILIARY LID HINGEDLY MOUNTED ON THE MAIN-LID

[75] Inventor: Timothy M. Holub, Cheney, Kans.

[73] Assignee: The Coleman Company, Inc., Wichita, Kans.

[21] Appl. No.: 946,565

[22] Filed: Sep. 18, 1992

[51] Int. Cl.[5] ..... B65D 51/18; E05D 5/00

[52] U.S. Cl. ..... 220/254; 220/334; 220/469; 220/627; 16/383; 62/457.7

[58] Field of Search ..... 220/254, 259, 334, 337, 220/338, 627, 469; 16/383; 62/457.7

[56] References Cited

U.S. PATENT DOCUMENTS

| | | | |
|---|---|---|---|
| 1,621,322 | 3/1927 | Hawn . | |
| 1,637,494 | 8/1927 | Marsh . | |
| 1,998,681 | 4/1935 | Littleford . | |
| 2,511,648 | 6/1950 | Milholland . | |
| 3,966,084 | 6/1976 | Box | 220/326 |
| 4,165,804 | 8/1979 | Georgopoulos | 220/254 X |
| 4,368,622 | 1/1983 | Brooks . | |
| 4,456,141 | 6/1984 | Pamment | 220/254 |
| 4,615,464 | 10/1986 | Byrns | 220/469 |
| 4,667,484 | 5/1987 | Tarozzi et al. | 62/457.7 X |
| 4,679,700 | 7/1987 | Tharrington et al. | 220/337 |
| 4,776,478 | 10/1988 | Miller et al. | 220/337 X |
| 5,064,088 | 11/1991 | Steffes . | |
| 5,080,251 | 1/1992 | Noack | 220/335 |
| 5,111,956 | 5/1992 | Jow | 220/338 |
| 5,156,291 | 10/1992 | Mielke | 220/254 |

*Primary Examiner*—Allan N. Shoap
*Assistant Examiner*—Vanessa Caretto

[57] ABSTRACT

A container includes a main lid for closing the container and an auxiliary lid for closing an opening in the main lid. The auxiliary lid provides access to the container without opening the main lid. The auxiliary lid is hingedly attached to the main lid by a pair of hinges which extend through hinge openings in the main lid and which are releasably secured within the hinge openings.

8 Claims, 3 Drawing Sheets

66
24

55
53
52

66
67
11
64
62
24
65

49
50
54
53
52
56
69
52
59
57
58
51

55
49
56
59
51

55
49
54
50
53
68
41
59
69
51
57
58

63
24
66
65

63
24
66
66
65
67
11

63
66
61
24
65
64
62
64
65

CONTAINER WITH MAIN LID AND AUXILIARY LID HINGEDLY MOUNTED ON THE MAIN-LID

BACKGROUND

This invention relates to storage containers, and, more particularly, to a lid for a storage container which is provided with an auxiliary opening and an auxiliary lid for closing the auxiliary opening.

The invention will be explained in conjunction with a cooler or ice chest. However, it will be understood that the invention can be used with other types of storage containers which include a lid for closing the container.

Coolers or ice chests conventionally include an open-topped container body and a lid for closing the top of the container body. Ice or a cold medium is placed within the container body for maintaining the interior and the contents of the container cool. The lid closes the container body and assists in maintaining the cool temperature within the container. However, when the lid is raised in order to remove some of the contents, a substantial amount of the cool air is allowed to escape.

SUMMARY OF THE INVENTION

The invention provides a main lid which is provided with an auxiliary opening and an auxiliary lid which is hingedly secured to the main lid for opening and closing the auxiliary opening. The auxiliary lid is supported by a pair of hinges which extend through hinge openings in the main lid and which are releasably retained therein. The auxiliary lid allows access to the interior of the container without opening the main lid, thereby reducing the amount of cool air which is allowed to escape.

DESCRIPTION OF THE DRAWING

The invention will be explained in conjunction with an illustrative embodiment shown in the accompanying drawing, in which.

DESCRIPTION OF THE SPECIFIC EMBODIMENT

Figure 1:
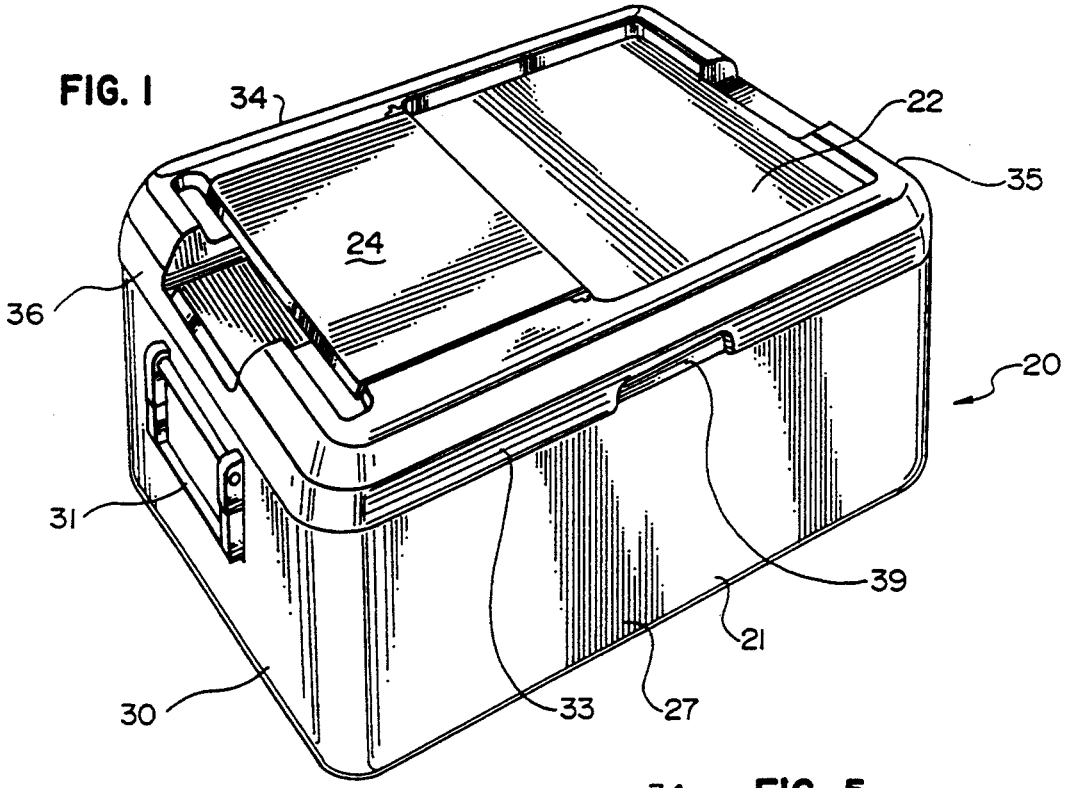
FIG. 1 is a perspective view of a cooler which includes a lid formed in accordance with the invention.
Figure 5:
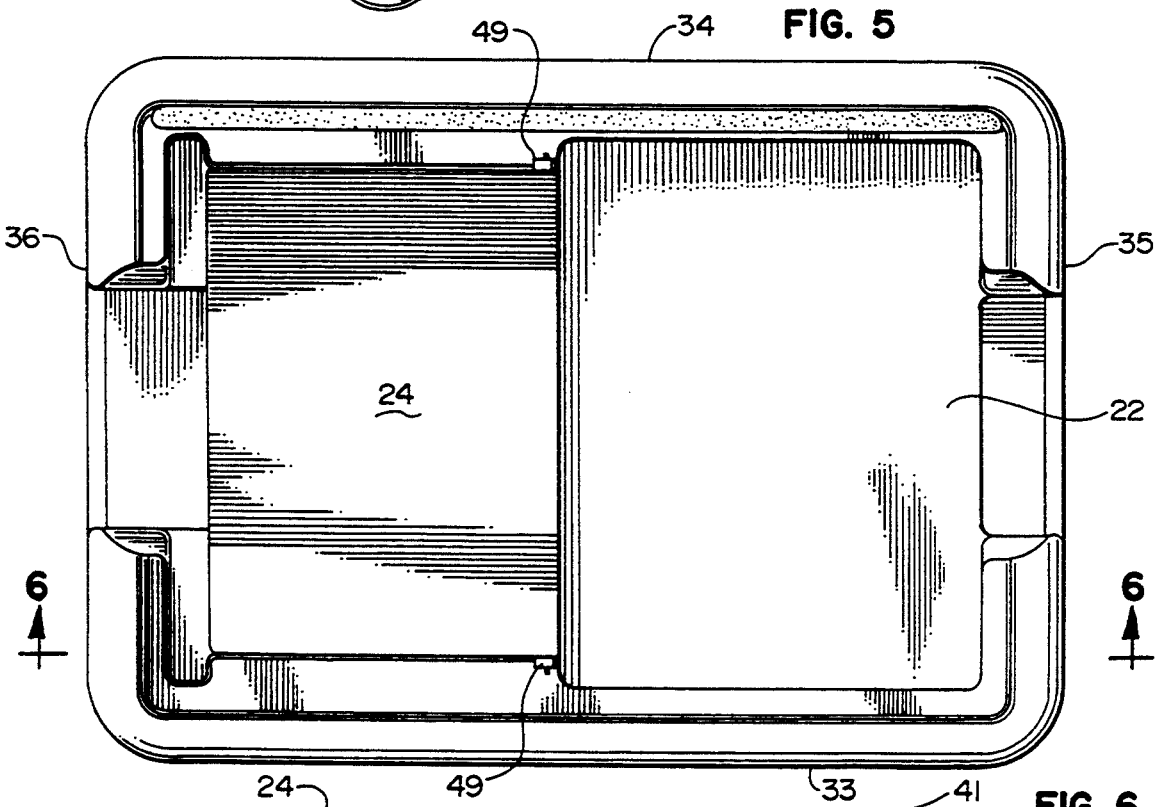
FIG. 5 is a top plan view of the main lid.

Referring to FIGS. 1–4, the numeral 20 designates generally a container which includes an open-topped container body 21 and a main lid 22. The main lid is provided with an auxiliary opening 23, and an auxiliary lid 24 is hingedly secured to the main lid for opening and closing the auxiliary opening. The particular container illustrated is a cooler or ice chest, but the invention can be used with other types of containers.

The container body 21 is generally rectangular and includes a bottom wall 25 and a perimetric side wall 26 which extends upwardly from the bottom wall. The side wall includes a pair of elongated side portions 27 and 28 and a pair of shorter end portions 29 and 30. A handle 31 is secured to each of the end portions.

The main lid 22 is also rectangular, and the periphery of the main lid has essentially the same shape as the periphery of the upper edge 32 of the container body. The main lid includes a pair of elongated outer side edges 33 and 34, a pair of shorter end outer edges 35 and 36, and an internal edge 37 which defines the auxiliary opening 23. In the particular embodiment illustrated the main lid is hingedly secured to the container body by a pair of hinges 38 (FIG. 2) which are secured to the side portion 28 of the container body and the side edge 34 of the lid. A recess 39 is provided in the side portion 33 to facilitate opening the lid.

Figure 6:
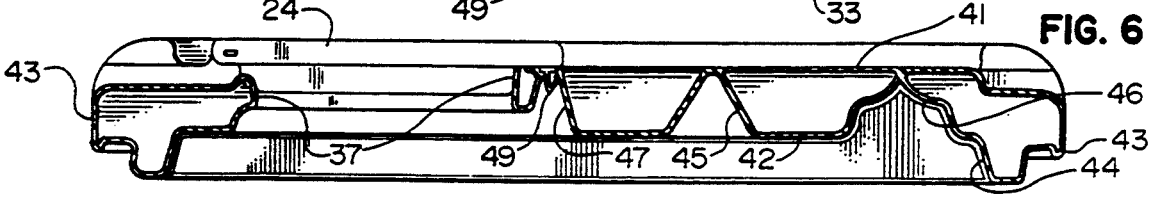
FIG. 6 is a sectional view taken along the line 6—6 of FIG. 5.

Referring to FIG. 6, the main lid includes top and bottom walls 41 and 42 and a side wall 43. The main lid is advantageously formed by blow molding high density polyethylene. The bottom wall includes a downwardly extending U-shaped rim 44 which fits snugly into the container body 21 to provide a friction fit with the container body.

The top and bottom walls of the main lid are separated throughout most of the lid to provide an insulated double-walled construction, but the bottom wall includes a plurality of upwardly extending portions which are joined to the top wall for providing rigidity and strength to the lid. For example, the bottom wall includes a conically shaped portion 45 (FIGS. 2 and 6) and a generally V-shaped portion 46 which extends across the main lid inside of the U-shaped rim 44. The portions 45 and 46 of the bottom wall can be fused or welded to the top wall during molding of the lid. A pair of conically shaped portions 47 and 48 extend upwardly and are welded to the top wall adjacent the auxiliary opening 23 in the main lid.

A hinge opening is punched through the flat welded area where each of the conical portions 47 and 48 are joined to the top wall of the lid, and a hinge 49 is inserted into each of the hinge openings. Referring to FIGS. 12–15, each hinge includes a journal portion 50 and a generally V-shaped attaching portion 51. The journal portion includes a generally horizontal base portion 52 which is supported by the top wall of the main lid and an upwardly extending wall 53 which is provided with a circular opening 54. A locating pin 55 extends horizontally from the top of the wall 53.

The V-shaped attaching portion includes a first leg 56 which extends vertically downwardly from the base 52 and a second leg 57 which extends angularly upwardly from the bottom of the first leg. The hinge is molded from flexible and resilient plastic, for example, Delron II 500, and the leg 57 is flexible relative to the leg 56. A knob or detent 58 is molded on the first leg 56 and is engageable with the leg 57 to prevent excessive flexing of the leg 57 and also serves as a pad for an ejector pin in the injection mold.

The hinge is attached to the main lid by pushing the V-shaped legs 56 and 57 through one of the hinge openings. The leg 57 flexes toward the leg 56 until the top of the leg passes below the welded area of the bottom wall. The resilient leg 57 then snaps back toward its original position until the bottom edge of the hole punched into the flat welded area contacts the corner of the top of leg 57 and the cam projection 68 to retain the hinge in the hinge opening. A detent 59 extends outwardly from the leg 56 opposite the leg 57 and assists in preventing inadvertent withdrawal of the hinge from the hinge opening. The locating pin 55 extends into a slot in the top wall of the main lid and prevents the hinge from twisting.

Referring to FIGS. 7–11, the auxiliary lid 24 also has a double-walled construction which is provided by top and bottom walls 61 and 62 and side wall 63. Five conically shaped portions 64 of the bottom wall extend upwardly and are fused or welded to the top wall to rigidify the auxiliary lid. The auxiliary lid is also advantageously formed by blow molding high density polyethylene.

The bottom wall includes a downwardly extending U-shaped rim 65 which is sized to fit snugly within the auxiliary opening 23 of the main lid. A pair of pivot pins or lugs 66 project outwardly from opposite sides of the auxiliary lid and are molded integrally with the auxiliary lid. A pair of detents 67 (FIGS. 9 and 10) project outwardly from one of the sides of the rim 65 and are engageable with the main lid to frictionally retain the auxiliary lid in the closed position illustrated in FIG. 1.

Figures 7, 8, 9, 10, 11, 12, 13, 14, 15:
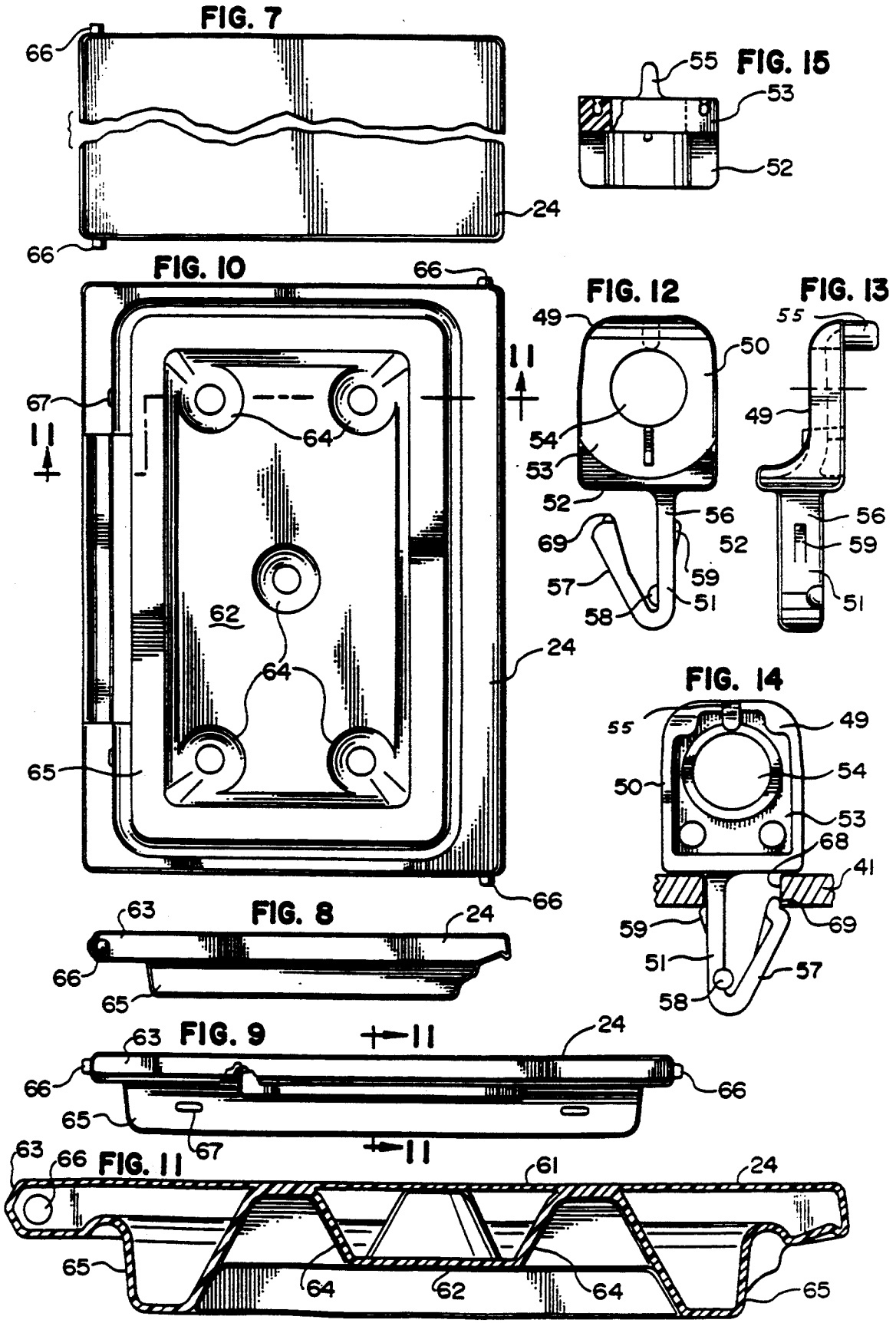
FIG. 7 is a fragmentary top plan view of the auxiliary lid.
FIG. 8 is a side elevational view, partially broken away, of the auxiliary lid.
FIG. 9 is a front elevational view, partially broken away of the auxiliary lid.
FIG. 10 is a bottom plan view of the auxiliary lid.
FIG. 11 is an enlarged sectional view taken along the line 11—11 of FIG. 10.
FIG. 12 is a side elevational view of one of the hinges for the auxiliary lid.
FIG. 13 is a front elevational view of the hinge.
FIG. 14 is a side elevational view of the hinge.
FIG. 15 is a top plan view, partially broken away, of the hinge.

The auxiliary lid is attached to the main lid by first inserting the hinge pins 66 into the hinges 49 and then pushing the V-shaped legs 56 and 57 of the hinge pins downwardly through the hinge openings 68 (FIG. 14) in the main lid. The hinges can be removed if necessary in order to permit the auxiliary lid to be repaired or replaced. The hinges can be removed by squeezing the legs 56 and 57 together and then pulling the legs through the hinge opening. A cam projection 69 (FIGS. 12 and 14) on the upper end of leg 57 facilitates withdrawing the leg 57 upwardly through the hinge opening. The projection extends into the hinge opening in the lid and bears against the edge of the opening as illustrated in FIG. 14.

Figure 2:
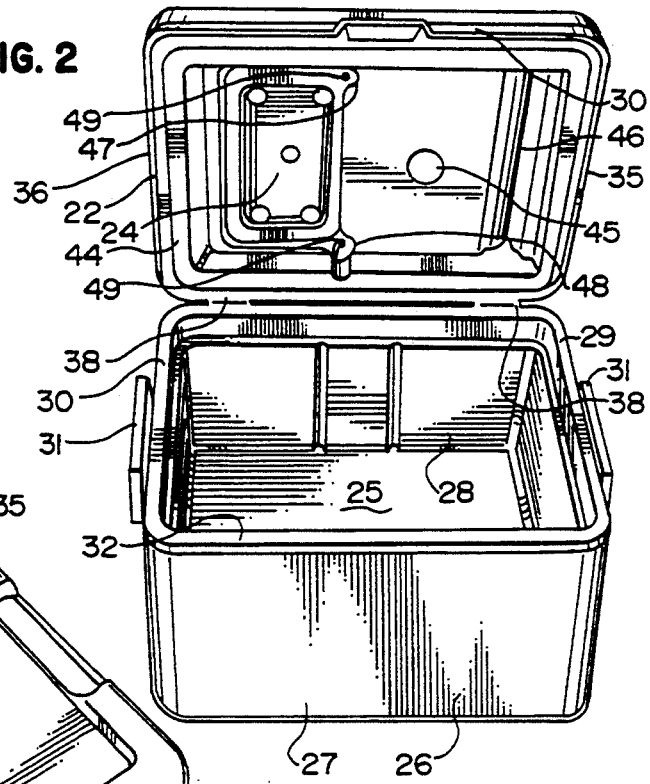
FIG. 2 is a front perspective view of the cooler with the main lid open.
Figure 3:
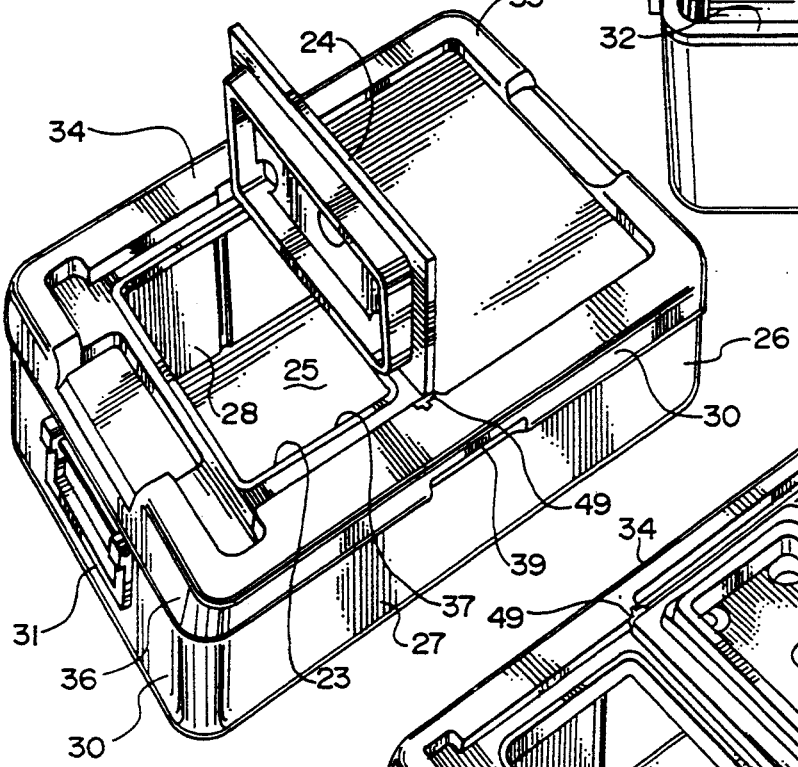
FIG. 3 is a view similar to FIG. 1 showing the auxiliary lid partially open.
Figure 4:
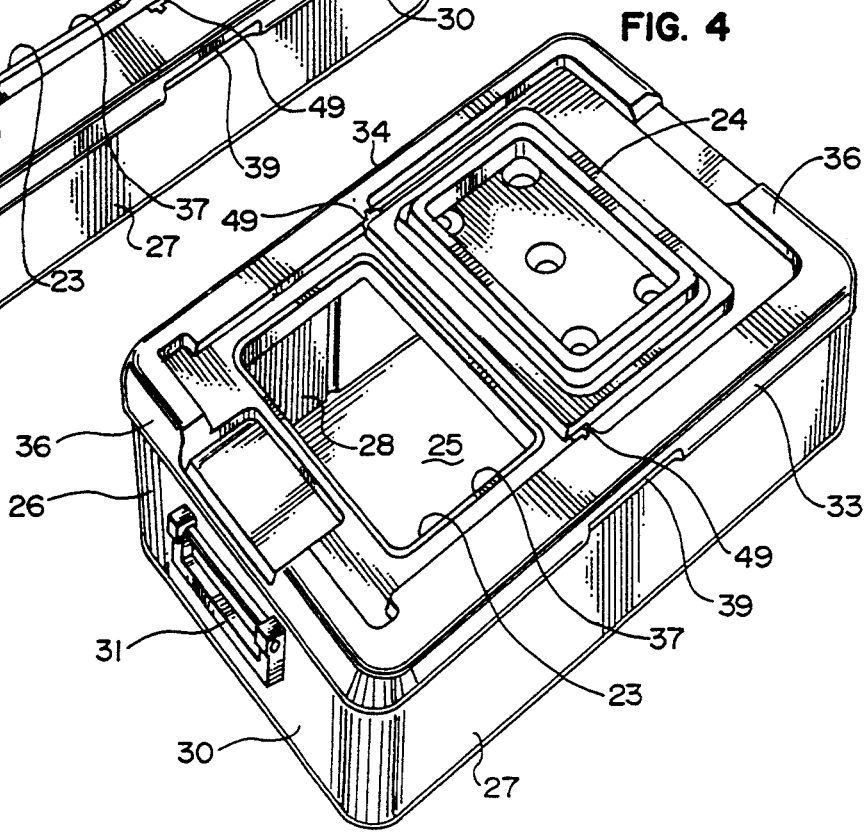
FIG. 4 is a view similar to FIG. 3 showing the auxiliary lid fully open.

When the cooler is to be filled with ice or food or beverages, the main lid 22 can be raised as illustrated in FIG. 2. Thereafter, when it is desired to remove a beverage can or small items from the cooler, the auxiliary lid 24 can be raised as illustrated in FIG. 3 to provide access to the interior of the cooler without opening the main lid. The auxiliary lid also permits items to be placed on the right hand portion of the main lid, and those items need not be removed in order to raise the auxiliary lid and gain access to the interior of the cooler.

The auxiliary lid is provided with detents which engage catches on the main lid for retaining the auxiliary lid in the generally vertical position illustrated in FIG. 3. The detents can be overcome if desired by applying additional force to the auxiliary lid in order to rotate the auxiliary lid to the fully open position illustrated in FIG. 4.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A container comprising an open-topped container body and a main lid for closing the open top of the container body, the main lid being provided with an auxiliary opening and a pair of hinge openings adjacent the auxiliary opening, a pair of hinges extending through the hinge openings in the main lid, each of the hinges including an attaching portion and a journal portion, the attaching portion of each hinge extending through one of the hinge openings and being releasably secured therein, the attaching portion of each hinge being generally V-shaped and including a first leg which is attached to the journal portion and a second leg which is flexibly and resiliently attached to the first leg whereby the second leg can flex toward the first leg when the attaching portion is inserted through a hinge opening in the main lid and resiliently move away from the first leg after the second leg passes through the hinge opening to secure the attaching portion within the hinge opening, and an auxiliary lid for closing the auxiliary opening in the main lid, the auxiliary lid including a pair of hinge pins which are rotatably supported by the journal portions of the hinges.

2. The container of claim 1 in which the attaching portion of each hinge pin includes a detent on one of the legs for preventing excessive flexing of the second leg toward the first leg.

3. The container of claim 1 in which the first leg of each of the attaching portions includes a detent on the side of the first leg opposite the second leg, the detent being engageable with the main lid for preventing withdrawal of the attaching portion from the hinge opening unless the second leg is flexed toward the first leg.

4. The container of claim 1 in which the main lid includes top and bottom walls which are joined around their peripheries to form a double-walled lid, at least two portions of the top and bottom walls extending toward each other and being secured together, said hinge openings being provided in said secured-together portions of the top and bottom walls.

5. A container comprising an open-topped container body and a main lid for closing the open top of the container body, the main lid having top and bottom walls which are joined around their peripheries to form a double-walled lid, the main lid being provided with an auxiliary opening, two portions of the top and bottom wall extending toward each other and being secured together adjacent the auxiliary opening, each of said secured-together portions of the top and bottom walls being provided with a hinge opening, a pair of hinges extending through the hinge openings, and an auxiliary lid for closing the auxiliary opening in the main lid, the auxiliary lid being rotatably supported by the hinges.

6. A cooler comprising an open-topped container body and a main lid for closing the open top of the container body, the main lid having top and bottom walls which are secured together to form a double-walled lid, the main lid being provided with an opening, a pair of hinges which extend through hinge openings in the top and bottom walls adjacent the opening in the main lid, each of the hinges including an attaching portion and a journal portion, the attaching portion of each hinge extending through one of the hinge openings and being releasably secured therein, the attaching portion of each hinge being generally V-shaped and including a first leg which is attached to the journal portion and a second leg which is flexibly and resiliently attached to the first leg whereby the second leg can be flexed toward the first leg when the attaching portion is inserted through a hinge opening in the main lid and resiliently move away from the first leg after the second leg passes through the hinge opening to secure the attaching portion within the hinge opening, and a small lid for closing the opening in the main lid, the small lid including a pair of hinge pins which are rotatably supported by the journal portions of the hinges.

7. The cooler of claim 6 in which the main lid is hingedly secured to the container body.

8. The cooler of claim 6 in which two portions of the top and bottom walls of the main lid extend toward each other and are secured together adjacent the opening in the main lid, said hinge openings being provided in said secured-together portions of the top and bottom walls.

* * * * *